United States Patent [19]

Hamuro et al.

[11] 4,195,975

[45] Apr. 1, 1980

[54] STABILIZED FUEL SLURRY

[75] Inventors: Yasumasa Hamuro, Kyoto; Akihiro Naka, Joyo; Shuichi Honjo, Kyoto, all of Japan

[73] Assignee: Dai-Ich Kogyo Seiyaku Co., Ltd., Kyoto, Japan

[21] Appl. No.: 897,028

[22] Filed: Apr. 17, 1978

[51] Int. Cl.[2] ..... C10L 1/32

[52] U.S. Cl. ..... 44/51; 252/353; 252/356

[58] Field of Search ..... 44/51; 252/353, 356

[56] References Cited

U.S. PATENT DOCUMENTS

| | | | |
|---|---|---|---|
| 2,344,688 | 3/1944 | Folkrod | 252/356 |
| 2,397,859 | 4/1946 | Hersberger | 44/51 |
| 3,671,428 | 6/1972 | Kim | 252/356 |
| 3,686,133 | 8/1972 | Hattori et al. | 252/353 |
| 3,986,979 | 10/1976 | Moorer et al. | 252/353 |
| 4,069,022 | 1/1978 | Metzger | 44/51 |

*Primary Examiner*—Winston A. Douglas
*Assistant Examiner*—Y. Harris-Smith
*Attorney, Agent, or Firm*—Haight & Huard

[57] ABSTRACT

A fuel slurry comprising a mixture of a fuel oil and pulverized coal may be effectively stabilized with a small amount of a condensation product of a sulfonated benzene or naphthalene derivative-formaldehyde, ligninsulfonic acid, carboxymethylcellulose, carboxymethyl-starch or a salt thereof.

17 Claims, No Drawings

STABILIZED FUEL SLURRY

This invention relates to a stabilized fuel slurry composition comprising a fuel oil and pulverized coal.

Pulverized coal has certain disadvantages which limit the use thereof as fuel, such as difficulty in transportation and storage, low heat value, difficulty in combustion-control and the like. Mixtures of pulverized coal with fuel oils generally eliminate these disadvantages because they are similar to fuel oils in many respects such as fluidity while their costs per unit heat value are generally lower than fuel oils. The history of the study in this field goes back to the works by Herman Plauson in 1913, C. J. Greenstreet in 1920, J. W. Leadbeater in 1922, A. G. Balcke in 1932 and F. Uhde in 1936. In these works attempts were directed to the stabilization of the mixture of pulverized coal and fuel oils to prevent the mixture from being separated into its components due to the density differential between the coal and the fuel oil. A number of additives were tested as stabilizers including soaps, milk, gelatin, starch, albumin, gums, heavy paraffin, cyclic olefins, resinates, oleates, stearates, palmitates, creosote oil, alkalis, anthrathene oil, coal tar, phenols, pyridine, aniline, naphthalene and the like. With the use of these additives at a concentration greater than 1% by weight it was impossible to obtain a satisfactory stabilization for a month or more. This insufficient stability and the relatively large amounts of additives made the resulting mixture expensive and impractical.

Recently studies on fuel slurries of this type have been revived. U.S. Pat. No. 3,615,095 discloses a gel-type pulverized coal-oil mixture wherein particles of pulverized coal are dispersed in an O/W type thixotropic emulsion of oil. The amount of emulsifier needed exceeds 1% by weight of the resultant mixture and the cost thereof makes it impractical. U.S. Pat. No. 3,907,134 discloses the use of starch and a detergent as a stabilizing agent and a viscosity reducing agent respectively for stabilizing the fuel slurry comprising pulverized coal and fuel oil, but the stability of the resultant slurry is not satisfactory.

Accordingly it is an object of the present invention to provide a method for stabilizing a fuel slurry comprising pulverized coal and fuel oil with a minimum amount of a stabilizing agent.

Another object of the present invention is to provide a composition comprising fuel oil and pulverized coal which is stable, i.e., no appreciable sedimentation of pulverized coal will take place for a long period of time.

According to the present invention, a fuel slurry composition is provided which comprises 20 to 60 weight % of pulverized coal having an average particle size of 10 to 200 microns, 1 to 30 weight % of water, the balance of a fuel oil and an effective amount of a stabilizing agent selected from the group consisting of a condensate of a sulfonated benzene or naphthalene derivative with formaldehyde or a salt thereof, ligninsulfonic acid or a salt thereof, carboxymethylcellulose or a salt thereof and carboxymethylstarch or a salt thereof. With the use of said stabilizing agent in an amount of 0.05 to 0.5% by weight relative to the entire composition, the resulting slurry is stable for at least 3 months at room temperature or for at least one month at 70° C. and no appreciable sedimentation of pulverized coal takes place during said period. The slurry may be pumped and burned with conventional equipments such as water boilers or furnaces.

The fuel slurry of the present invention may contain to its advantage an effective amount of an anionic sulfate or an anionic sulfonate surfactant to improve the fluidity thereof by decreasing the viscosity.

In practising the present invention various types of coal may be used regardless of their place of production, chemical constitution or moisture content, and include anthracite, bituminous coal, sub-bituminous coal, lignite and the like. The coal may be pulverized in conventional manner either in dry process or in wet process in oil using various types of mills. Pulverization of coal has long been commercial practice and, therefore, there is no need for further explanations thereon. Average particle size of the pulverized coal to be employed in the present invention is preferably less than 200 microns and smaller particle size is preferred. Since excessive energy is required to obtain a particle size less the 10 microns, the lower limit is a matter of economy.

The content of pulverized coal in the final fuel slurry preferably ranges from 20 to 60% by weight, more preferably from 30 to 50% by weight. Higher coal contents result in an increase in viscosity with an decrease in fluidity and lower coal contents are economically insignificant.

The term "fuel oils" as used herein means petroleum crude oil and liquid fractions thereof such as kerosene, light oil, heavy oils such as bunker A, bunker B and bunker C, cracked residue of ethylene; coal tar fractions such as creosote oil and anthracen oil; various waste oils such as motor oils, lubricants, machine oils, cutting oils, cleaning oils, waste oils from marines, waste oils from chemical plants and mixtures of these oils. Among them petroleum crude oil, bunker A, bunker B and bunker C are most preferable because they may be easily available in large quantities at a relatively lower cost. In cases where two or more different types of oils are to be mixed, they may be mixed either prior to or subsequent to the mixing step with pulverized coal.

The fuel slurry of the present invention contains 1 to 30%, preferably 2 to 20% by weight of water relative to the entire slurry composition for improving the stability thereof and cleanliness of flue gas in terms of decrease in dust and NOx. A water content higher than 30% by weight causes excessive heat loss and decrease in heat value.

Condensation products of a sulfonated benzene or naphthalene derivative with formaldehyde may be prepared by reacting a benzene or naphthalene derivative such as xylene, $C_2$-$C_{20}$ alkylbenzene, phenol, $C_2$-$C_{20}$ alkylphenol, naphthalene and $C_2$-$C_{20}$ alkylnaphthalene with 0.3 to 2.0 equivalents, preferably 0.5 to 1.2 equivalents of a sulfonating agent such as sulfuric acid, fuming sulfuric acid, chlorosulfonic acid, sodium hydrogen sulfate or sulfamic acid at a temperature of 20° to 160° C., optionally adding water to the reaction mixture, and a reacting the resulting product with 0.1 to 2 equivalents, preferably 0.5 to 1.2 equivalents of formaldehyde. The above reaction and the condensate are well known in the art and, therefore, there is no need for further explanation thereof. Examples of preferred condensates include naphthalenesulfonic acid-formaldehyde condensate, $C_2$-$C_{20}$ alkyl-naphthalenesulfonic acid-formaldehyde condensate and $C_2$-$C_{20}$ alkylbenzenesulfonic acid-formaldehyde condensate. A salt of the condensate such as sodium, potassium, calcium, magnesium, aluminum, iron, nickel, ammonium, alkylamine, alkyleneamine or alkanolamine salt may also be employed.

Ligninsulfonic acid and salts thereof may be prepared from lignin or waste pulp liquor in known manner and are commercially available. The salts which may be employed in the present invention include those having cationic components as just mentioned and sodium or calcium salt is preferable.

Carboxymethylcellulose and carboxymethylstarch may be prepared by reacting appropriate starting material with monochloroacetic acid or its sodium salt in known manner. The starting cellulose and starch may be of any type. Preferably they may be partly degraded prior to or subsequent to the carboxymethylation reaction by the action of an alkali, an acid or an enzyme into a molecular weight of 1,000 to 150,000, preferably 1,000 to 70,000, more preferably 2,000 to 30,000. Typically they are used in the form of a water-soluble salt such as sodium salt.

The above stabilizing agent may be used in conjunction with other anionic surfactants or nonionic surfactants. In this case the above stabilizing agent must be present in amounts of at least 20%, preferably 40 % by weight of the mixture.

Usually addition of 0.05% to 0.5% by weight of the above agent is sufficient to stabilize the fuel slurry. The stabilizing agent may be added to oil and/or water and then the mixture is mixed with pulverized coal, although the components of the fuel slurry of the present invention may be mixed in any desired order. The mixing is carried out in conventional equipment of low shear types and the use of a strong mixer or specially designed mixers is not needed.

The resulting fuel slurry is a dispersion of pulverized coal in a fuel oil or in a W/O emulsion thereof. The fuel slurry is stable for at least 3 months at room temperature or for at least one month at 70° C. on storage without causing sedimentation of pulverized coal in any appreciable amount. The fuel slurry may be burnt in conventional equipment in a similar manner to the burning of oils.

The fuel slurry of the present invention may contain an effective amount, e.g. 0.01% to 0.5% by weight of an anionic sulfate or an anionic sulfonate surfactant for improving fluidity and decreasing viscosity. Examples of the anionic surfactant used for said purpose include alkylbenzene sulfonates, phenolsulfonates, $C_8$-$C_{20}$ alkanol sulfates and sulfates of polyoxyethylene-fatty alcohol or alcohol ether having an average of 2–15 oxyethylene units ($\bar{n}$=2–15) or a salt of polyoxyethylene alkylphenol sulfate having an average of 2–10 oxyethylene units ($\bar{n}$=2–10) and 6–13 carbon atoms in the alkyl group. Use of such anionic surfactant in combination with the stabilizing agent is particularly advantageous when (1) concentration of pulverized coal is relatively high, e.g. higher than 30% by weight, (2) water content is high, e.g. higher than 3%, particularly above 10% by weight, or (c) ambient temperature is low. This surfactant may be added to the fuel slurry from the beginning or immediately before pumping or burning.

Although the reason why the stabilizing agent used in the present invention exhibits an excellent result cannot be fully explained yet, it is postulated as follows. The stabilizing agents have sulfonic or carboxylic groups in their molecules and are easily adsorbed onto the hydrophilic surface of pulverized coal due to the presence of such polar acid groups when they are mixed with pulverized coal. Once the stabilizing agents have been adsorbed on the surface of particles of pulverized coal, the bulk of their molecules prevents the particles of pulverized coal from colliding with each other and thus agglomeration thereof is minimized.

The fuel slurry and the preparation thereof according to the present invention are more fully illustrated by the following examples. These examples are included here for the purpose of illustration only and are not intended as a limitation. All percents therein are by weight.

EXAMPLE 1

Australia bituminous coal was pulverized in a mill to an average particle size of 70 microns. As a fuel oil bunker C was used. As a stabilizing agent one of the following sulfonate-formaldehyde condensates was used respectively:

(i) Condensate of sodium naphthalenesulfonate-formaldehyde.

(ii) Condensate of diethanolamine salt of methylnaphthalene-sulfonic acid-formaldehyde.

(iii) Condensate of sodium naphthalenesulfonate-sodium phenolsulfonate-formaldehyde.

To a 5 $m^3$ capacity iron tank having a spiral mixing blade and a steam jacket were charged 1500 kg of bunker C oil, 1500 kg of the pulverized coal having a moisture content of 3%, 10 kg of a 50% aqueous solution of the stabilizing agent and 60 kg of water. Bunker C was preheated at 100° C. Then the mixture was stirred at 300 r.p.m. for 20 minutes at 70° C.

A quantity of each resulting fuel slurry was allowed to stand at room temperature for 3 months or at 70° C. for one month in a cylinder of 10 cm diameter × 100 cm height and samples were taken from the upper layer and the lower layer respectively to determine the concentration of pulverized coal and the density. The results showed that the difference in the concentration and the density between the upper and lower layers was within 3% in each case. The resultant fuel slurry had a viscosity of about 3000 cPs at 70° C., and was easily pumped and burned in conventional boilers or furnaces.

EXAMPLE 2

Indonesia sub-bituminous coal was pulverized in crude oil to obtain a mixture containing 40% of pulverized coal of an average particle size of 120 microns and 8% of water. The mixture was mixed continuously with an aqueous solution of calcium ligninsulfonate, sodium carboxymethylcellulose or sodium carboxymethylstarch by passing through a line having a turbine mixer installed therein so that the final concentration of the stabilizing agent was 0.1%.

The resultant fuel slurry showed good pumping and burning properties and no appreciable sedimentation of pulverized coal took place on storage for 3 months at room temperature or for one month at 70° C.

EXAMPLE 3

The process of Example 1 was repeated except that 150 kg, 300 kg or 450 kg of water was added. The resulting fuel slurry in each case was superior to that of Example 1 in the stability and the pumping and burning properties.

EXAMPLE 4

The process of Example 2 was repeated except that the water content in the final mixture was varied at 5%, 10% or 15%. The resulting fuel slurry in each case as satisfactory as that of Example 2.

EXAMPLE 5

The process of Example 1 was repeated except that Australia anthracite replaced Australia bituminous coal and the concentration thereof was varied at 20%, 30% or 40%. The resulting fuel slurry was as satisfactory as that of Example 1 with a decrease in viscosity to 400 to 1500 cPs.

EXAMPLE 6

The process of Example 1 was repeated except that triethanolamine salt of alkylbenzene-sulfonate or sodium salt of polyoxyethylene ($\bar{n}=8$)-laurylether sulfate was added in an amount sufficient to make a final concentration of 0.05%. The viscosity of the resultant fuel slurry decreased to about 700 cPs at 70° C. while the stability remained unchanged. This slurry may be pumped with a power consumption of about a half of that required for the product of Example 1, and showed improved spraying and burning properties.

EXAMPLE 7

The process of Example 2 was repeated except that ammonium polyoxyethylene ($\bar{n}=5$) nonylphenolether sulfate or sodium salt of sulfuric ester of $C_{12}$-$C_{15}$ synthetic aliphatic alcohol was added in an amount sufficient to make a final concentration of 0.03%. The viscosity of the resultant slurry decreased to about 400 cPs at 70° C. while the stability remained unchanged. This slurry may be pumped with a power consumption of about a half of that required for the product of Example 2 and showed improved spraying and burning properties.

It is to be understood that the foregoing detailed description is given merely by way of illustration and that many variations may be made therein without departing from the spirit of the present invention.

What is claimed is:

1. A fuel slurry composition comprising a fuel oil, 20 to 60% of pulverized coal having an average particle size of 10 to 200 microns, an effective amount of a stabilizing agent selected from the group consisting of a condensate of a sulfonated benzene or naphthalene derivative with formaldehyde, a salt thereof, carboxymethylcellulose, a salt thereof, carboxymethylstarch and a salt thereof and 1 to 30% of water present in an amount sufficient to further stabilize the slurry, all % being by weight relative to the entire composition.

2. The composition of claim 1, wherein said stabilizing agent is a condensation product of a salt of naphthalenesulfonic acid and formaldehyde.

3. The composition of claim 1, wherein said stabilizing agent is a condensation product of a salt of $C_1$-$C_4$ alkylnaphthalenesulfonic acid and formaldehyde.

4. The composition of claim 1, wherein said stabilizing agent is a condensation product of a salt of naphthalene-sulfonic acid and a salt of phenolsulfonic acid-formaldehyde.

5. The composition of claim 1, wherein said stabilizing agent is a condensation product of $C_6$-$C_{13}$ benzenesulfonic acid and formaldehyde.

6. The composition of claim 1, wherein said stabilizing agent is carboxymethylcellulose or a salt thereof.

7. The composition of claim 1, wherein said stabilizing agent is carboxymethylstarch or a salt thereof.

8. The composition of claim 1 containing an effective amount of a viscosity reducing agent selected from the group consisting of an anionic sulfonate surfactant and an anionic sulfate surfactant.

9. The composition of claim 8, wherein said viscosity reducing agent is a salt of $C_6$-$C_{13}$ alkylbenzene-sulfonic acid.

10. The composition of claim 8, wherein said viscosity reducing agent is a salt of phenol-sulfonic acid.

11. The composition of claim 9, wherein said viscosity reducing agent is a salt of sulfuric ester of $C_8$-$C_{20}$ aliphatic alcohol.

12. The composition of claim 8, wherein said viscosity reducing agent is a salt of polyoxyethylene alkylphenol sulfate having an average of 2–10 oxyethylene units and 6–3 carbon atoms in the alkyl group.

13. The composition of claim 8, wherein said viscosity reducing agent is a salt of sulfuric ester of polyoxyethylene alcohol ether having an average of 2–15 oxyethylene units.

14. The composition of claim 8, wherein said viscosity reducing agent is present in an amount less than that of said stabilizing agent.

15. The composition of claim 1, wherein said fuel oil is petroleum crude oil or a liquid fraction thereof.

16. The composition of claim 1, wherein said coal is anthracite, bituminous coal, sub-bituminous coal or lignite.

17. The composition of claim 1, wherein said water is present in an amount from 2 to 20% by weight of the entire composition.

* * * * *